United States Patent [19]

Smith, deceased

[11] 3,961,111

[45] June 1, 1976

[54] METHOD OF INCREASING CORROSION RESISTANCE OF ANODIZED ALUMINUM

[75] Inventor: Harold Vernon Smith, deceased, late of Philadelphia, Pa., by Jean E. Smith, administrator

[73] Assignee: Pennwalt Corporation, Philadelphia, Pa.

[22] Filed: Mar. 18, 1975

[21] Appl. No.: 559,614

[52] U.S. Cl. ..... 427/419; 148/6.27; 204/35 N

[51] Int. Cl.[2] ..... C25D 11/18

[58] Field of Search ..... 204/35 N; 148/6.1, 6.27; 427/419

[56] References Cited

UNITED STATES PATENTS

| | | | |
|---|---|---|---|
| 3,012,917 | 12/1961 | Riou et al. | 148/6.27 X |
| 3,026,255 | 3/1962 | Riou et al. | 204/35 N X |
| 3,607,452 | 9/1971 | Marosi | 148/6.27 X |
| 3,672,966 | 6/1972 | Geisler et al. | 204/35 N |
| 3,874,949 | 4/1975 | Kaneda et al. | 148/6.27 |

*Primary Examiner*—G. L. Kaplan
*Attorney, Agent, or Firm*—Robert G. Danehower

[57] ABSTRACT

Anodized aluminum oxide coatings are sealed in hot water containing [N-methyl - N - (3-dimethylamino - propyl)-n-perfluorooctylsulfonamide] methylammonium iodide, [N-ethyl-n-perfluorooctyl - sulfonamido tridecaethyleneoxy) ethanol and/or a copolymer of 70% by weight methacrylic acid and 30% by weight ethyl acrylate.

3 Claims, No Drawings

METHOD OF INCREASING CORROSION RESISTANCE OF ANODIZED ALUMINUM

DESCRIPTION OF INVENTION

Articles fabricated from aluminum and aluminum alloys have a long life which is generally measured by resistance to corrosion. In addition to being susceptible to galvanic action, aluminum and its alloys are constantly subject to corrosive attack from the atmosphere, sea water and corrosive conditions encountered in the chemical industry.

Aluminum is protected against corrosion by the formation of conversion coatings, and more importantly, by anodizing. While aluminum and aluminum alloys when exposed to the atmosphere will react with the atmosphere to form oxide films which protect it from further attacks, these natural oxide films are generally only 0.2 to 0.6 micro inches thick. These natural oxide films have little resistance to corrosion of any type and industry has resorted to the formation of artificial oxide films by anodizing. The oxide films formed by anodizing are not only superior mechanically, but are also of a much greater corrosion resistance, and in addition, they form a very suitable base for adsorbing organic finishes.

Anodizing is an electrical process in which aluminum or the aluminum alloy becomes the anode in an electric cell. In an aqueous electrolyte, oxygen becomes part of the anode reaction and unites chemically with the aluminum with the formation of aluminum oxides. While aluminum oxides are forming a film on the surface of the aluminum article — because of solubility of aluminum oxide there is also a simultaneous dissolution of the metal in the electrolyte. This constant formation and dissolution of metal creates pores in the aluminum surface which makes the anodized aluminum susceptible to corrosion although not to the extent of unanodized metal. The anodized films will range from 1 to 35 microns in thickness. Generally, a film of 1 to 3 microns is suitable as a paint base while aluminum designed for out-door use will have an anodized film of 5 to 10 microns thickness.

Anodizing takes place in aqueous solutions at current densities which vary from 1 to 30 amperes per square foot. Anodizing temperatures vary from 10° to 60°C. Sulfuric acid, phosphoric acid, and oxalic acid are generally used at 3 to 25% by weight concentration in order to assist in the passage of electric current. After anodizing, the articles are generally washed in clean cold running water followed by immersion in clean boiling water and then air dried. The anodic coating produced by the above processes are believed to consist of anhydrous aluminum oxide.

The porosity of the coating may be affected by many factors in the anodic treatment but mainly the porosity is due to the type of electrolyte used with the largest pores being produced by phosphoric acid coatings which the chromic acid coatings give the smallest pores. Because of the porous nature of the anodic oxide films of aluminum they are quite receptive to paints and dyes in a great variety of colors. However, the porosity of the oxide films also renders the paints and dyes subject to staining and weeping.

In order to overcome this drawback, it has been found that the porosity of the anodic film can be decreased by sealing it in steam or hot water. Hot water sealing is the simplest technique and the one most universally used. Sealing of anodized aluminum takes place in deionized or distilled water at a temperature of about 160° to 212°F. Generally, the pH is about 5 to about 7. The time of immersion in the aqueous sealing bath will generally be about two thirds of the anodizing time. This period will range from about 10 minutes to about 1 hour. It is generally believed that the hot water treatment causes hydration of the aluminum oxide film and thus closes the pores in the anodic coatings.

I have now discovered that the corrosion resistance of anodic coatings on aluminum and aluminum alloys can be increased by sealing them in hot water which has been modified by the addition of small amounts of certain organic materials. The sealing process of my invention is applicable to treating anodized surfaces of aluminum or aluminum alloys. It is to be understood hereafter in this specification and claims that when I am speaking of an aluminum surface it is is also my intent to include aluminum alloys.

The temperature of the sealing water will generally be in the range of 160° to 212°F, preferably in the range of 185° to 212°F. Deionized water is generally used for hot water sealing of aluminum since it is sufficiently free of heavy metals which could interfere with the sealing process. Distilled water, of course, would be quite acceptable but the cost of distilling is not usually justified when compared to the cost and availability of deionized water. The pH of the sealing water will generally be within the range of about pH 5 to about 7.

The sealing process of my invention is carried out in the same manner as the sealing treatment using the conventional nickle acetate solutions. For example, the articles to be sealed may be immersed in deionized water solutions or the sealing may be accomplished by spraying the articles. After sealing in the deionized water solutions the aluminum articles may be rinsed with water as required and dried. If desired, the water rinse can be omitted. Drying of the sealed aluminum is accomplished in any convenient manner merely by suspending the aluminum in hot air or by passing it through an oven.

The sealing compositions used in my process comprise water and one or more sealing additive for admixture with the sealing water selected from the group consisting of 1. [N-methyl-N-(3-dimethylaminopropyl)-n-perfluorocotylsulfonamide] methylammonium iodide represented by the structure $[C_8F_{17}SO_2N(CH_3)C_3H_6N(CH_3)_3[^+I^-$; 2. (N-ethyl-n-perfluorooctylsulfonamido tridecaethyleneoxy)ethanol represented by the structure $C_8F_{17}SO_2N(C_2H_5)(C_2H_4O)_{14}H$; and 3. a copolymer of 70% by weight methacrylic acid and 30% by weight ethyl acrylate, molecular weight range 20,000 to 50,000. These additives have the unexpected property of increasing the corrosion resistance of the anodized aluminum.

The sealing additives are useful at a minimum concentration of 0.001% by weight. Greater amounts can of course be used but without any significant increase in sealing efficiency as measured by salt spray corrosion tests. Mixtures of the sealing additives can also be used provided that the concentration of the additives together amounts to 0.001% by weight. Generally, excessively large amounts of additive are to be avoided to prevent staining of the finished aluminum and to obtain optimum economy of operation. Generally the amount of additive will not exceed 0.1% by weight of the sealing solution.

The best mode of practicing my invention will be apparent from a consideration of the following examples.

EXAMPLE 1

Thereafter the corrosion resistance of the sealed articles was compared with that of aluminum articles which were sealed without any additive by subjecting the articles to salt spray tests. (Federal Standard No. 151, Method 811). The results appear in Table 1.

TABLE I

| | Bath Composition | Corrosion Resistance of Aluminum Sealed in Hot Water Exposure to Salt Spray | | |
|---|---|---|---|---|
| | | 336 HOURS | 1152 HOURS | 2208 HOURS |
| (a) | Deionized Water (no additive) | No change | Slight Whitening | Gross discoloration and many small pits |
| (b) | Mixture of 0.1% by weight copolymer of 70% by weight methacrylic acid and 30% by weight ethyl acrylate in deionized water. | No change | No change | No change |
| (c) | Mixture of 0.00075% of $[C_8F_{17}SO_2N(CH_3)C_3H_6N(CH_3)_3]^+I^-$ and 0.00025% $C_8F_{17}SO_2N(C_2H_5)(C_2H_4O)_{11}H$ in deionized water. | No change | Trace of whitening | Slight whitening, no pitting |

Sections of 6063 aluminum alloy extrusions were processed as follows:

Clean — with inhibited mild alkaline cleaner at 45 grams per liter, at 160° - 170°F. for 5 minute immersion, Rinse — immersion in clean water, air agitated for 2 minutes at 75° - 90°F., Etch — chelated alkaline etchant at 45 grams per liter, at 145° - 150°F., immersion for 5 minutes, Rinse — immersion in clean water, air agitated for 2 minutes at 75° - 90°F., Desmut — Immersion in nitric acid, 25% volume, at 75° - 90°F. for 20 minutes, Rinse — immersion in clean water, air agitated for 2 minutes at 75° - 90°F., Anodize — aluminum alloy anodic, immersion in sulfuric acid, 15% by weight, at 68° - 72°F., 16 volts D.C. current applied for 30 minutes, Rinse — immersion in clean water, air agitated for 2 minutes at 75° - 90°F., Sealing — Immersion in deionized water for 20 minutes at 200°F. with sealing additives listed in Bath Composition shown in Table 1.

Following the immersion in the sealing solutions the aluminum articles were washed with water and dried.

I claim:

1. The process for sealing anodized aluminum comprising contacting the anodized aluminum with deionized or distilled water containing at least 0.001% by weight of one or more sealing additives selected from the group consisting of (N-methyl-N-(3-dimethylaminopropyl)-n-perfluorooctylsulfonamide) methylammonium iodide, and (N-ethyl-n-perfluorooctylsulfonamido tridecaethyleneoxy)ethanol for a period of time ranging from ten minutes to 1 hour and at a temperature within the range of about 160° to 212°F. and thereafter drying the sealed aluminum.

2. The process of claim 1 in which anodized aluminum is immersed in deionized water containing 0.00075% by weight (N-methyl-N-(3-dimethylaminopropyl)-n-perfluorooctylsulfonamide) methylammonium iodide and 0.00025% by weight (N-ethyl-n-perfluorooctylsulfonamido tridecaethyleneoxy)ethanol.

3. The process of claim 1 in which the sealed aluminum is rinsed with water prior to drying.

* * * * *

UNITED STATES PATENT OFFICE

CERTIFICATE OF CORRECTION

Patent No. 3,961,111 Dated June 1, 1976

Inventor(s) Harold Vernon Smith, deceased

It is certified that error appears in the above-identified patent and that said Letters Patent are hereby corrected as shown below:

Column 2, line 49 should read:

$[C_8F_{17}SO_2N(CH_3)C_3H_6N(CH_3)_3]^+I^-$;2. (N-ethyl-n-per-

Signed and Sealed this

Seventh Day of September 1976

[SEAL]

*Attest:*

RUTH C. MASON
*Attesting Officer*

C. MARSHALL DANN
*Commissioner of Patents and Trademarks*